US009915155B2

(12) United States Patent
Brandl et al.

(10) Patent No.: US 9,915,155 B2
(45) Date of Patent: Mar. 13, 2018

(54) ROTOR BLADE ARRANGEMENT AND GAS TURBINE

(71) Applicant: Ansaldo Energia IP UK Limited, London (GB)

(72) Inventors: Herbert Brandl, Waldshut-Tiengen (DE); Hans-Peter Bossmann, Lauchringen (DE); Philipp Indlekofer, Klettgau-Erzingen (DE)

(73) Assignee: ANSALDO ENERGIA IP UK LIMITED, London (GB)

( * ) Notice: Subject to any disclaimer, the term of this patent is extended or adjusted under 35 U.S.C. 154(b) by 0 days.

(21) Appl. No.: 14/568,706

(22) Filed: Dec. 12, 2014

(65) Prior Publication Data

US 2015/0098831 A1 Apr. 9, 2015

Related U.S. Application Data

(63) Continuation of application No. 12/617,825, filed on Nov. 13, 2009, now Pat. No. 8,951,015.

(30) Foreign Application Priority Data

Nov. 20, 2008 (CH) ..... 1809/08

(51) Int. Cl.
*F01D 5/30* (2006.01)
*F01D 5/14* (2006.01)
(Continued)

(52) U.S. Cl.
CPC ..... *F01D 5/303* (2013.01); *F01D 5/147* (2013.01); *F01D 5/3007* (2013.01);
(Continued)

(58) Field of Classification Search
CPC ..... F01D 5/30; F01D 5/3007; F01D 5/3021; F01D 5/303; F01D 5/3038; F01D 2240/55; F01D 5/3015; F01D 5/326
(Continued)

(56) References Cited

U.S. PATENT DOCUMENTS 3,294,366 A * 12/1966 Coplin ..... 416/220 R
3,628,890 A 12/1971 Sayre et al.
(Continued)

FOREIGN PATENT DOCUMENTS

DE 437049 C 11/1926
DE 19940556 A1 3/2001
(Continued)

OTHER PUBLICATIONS

Search report for Swiss Patent App. No. 1809/2008 (dated Feb. 9, 2009).

*Primary Examiner* — Justin Seabe
*Assistant Examiner* — Juan G Flores
(74) *Attorney, Agent, or Firm* — Buchanan Ingersoll & Rooney PC

(57) ABSTRACT

A rotor blade arrangement (20), especially for a gas turbine, which can be fastened on a blade carrier (19) and includes in each case a blade aerofoil element (10) and a platform element (14), wherein the platform elements (14) of a blade row form a continuous inner shroud. With such a blade arrangement, a mechanical decoupling, which extends the service life, is achieved by the blade aerofoil element (10) and the platform element (14) being formed as separate elements and by being able to be fastened in each case separately on the blade carrier (19).

13 Claims, 6 Drawing Sheets

(51) Int. Cl.
*F01D 9/04* (2006.01)
*F01D 11/00* (2006.01)

(52) U.S. Cl.
CPC ..... *F01D 5/3092* (2013.01); *F01D 9/04* (2013.01); *F01D 11/008* (2013.01); *F05D 2240/30* (2013.01); *F05D 2260/36* (2013.01)

(58) Field of Classification Search
USPC ..... 29/889.71; 416/193 A, 217, 223 R, 416/223 A, 224, 248
See application file for complete search history.

(56) References Cited

U.S. PATENT DOCUMENTS

| | | | | |
|---|---|---|---|---|
| 4,484,858 | A | 11/1984 | Kurosawa et al. | |
| 4,650,399 | A | 3/1987 | Craig et al. | |
| 4,684,326 | A | 8/1987 | Wassell et al. | |
| 5,030,063 | A * | 7/1991 | Berger | 416/220 R |
| 5,277,548 | A * | 1/1994 | Klein et al. | 416/193 A |
| 5,378,110 | A | 1/1995 | Ress, Jr. | |
| 5,741,119 | A * | 4/1998 | Heppenstall | F01D 5/3007 416/219 A |
| 5,791,877 | A * | 8/1998 | Stenneler | 416/221 |
| 6,632,070 | B1 | 10/2003 | Tiemann | |
| 7,329,087 | B2 | 2/2008 | Cairo et al. | |
| 7,399,159 | B2 * | 7/2008 | Matheny et al. | 416/62 |
| 7,762,781 | B1 | 7/2010 | Brown et al. | |
| 7,874,804 | B1 * | 1/2011 | Brown | 416/193 A |
| 7,878,763 | B2 | 2/2011 | Keith et al. | |
| 7,963,745 | B1 * | 6/2011 | Liang | 416/97 R |
| 7,972,113 | B1 | 7/2011 | Davies | |
| 2005/0118028 | A1 | 6/2005 | Matheny et al. | |
| 2006/0285973 | A1 | 12/2006 | Keller | |
| 2007/0122266 | A1 * | 5/2007 | Cairo et al. | 415/134 |
| 2008/0298973 | A1 | 12/2008 | Marini | |
| 2011/0058953 | A1 | 3/2011 | Simon-Delgado et al. | |
| 2012/0087795 | A1 | 4/2012 | Garin et al. | |
| 2013/0064667 | A1 | 3/2013 | Campbell et al. | |

FOREIGN PATENT DOCUMENTS

| | | | |
|---|---|---|---|
| EP | 0764765 | A1 | 3/1997 |
| EP | 1176284 | A2 | 1/2002 |
| EP | 1306523 | A1 | 5/2003 |
| GB | 791751 | A | 3/1958 |
| WO | WO 2005/054634 | A1 | 6/2005 |
| WO | WO 2007/012587 | A1 | 2/2007 |

* cited by examiner

ROTOR BLADE ARRANGEMENT AND GAS TURBINE

This application is a continuation of U.S. application Ser. No. 12/617,825, filed Nov. 13, 2009 which claims priority under 35 U.S.C. § 119 to Swiss application no. 01809/08, filed 20 Nov. 2008, the entirety of which are incorporated by reference herein.

BACKGROUND

Field of Endeavor

The present invention relates to the field of turbines, and to a rotor blade arrangement.

Brief Description of the Related Art

Blades for gas turbines, which are used in the compressor section or turbine section as stator blades or rotor blades, are customarily produced as one component by forging or precision casting. This especially also applies to blades which have a platform and/or a shroud segment.

The increase of efficiency and performance of modern gas turbine plants, which is necessary for environmental protection reasons, requires raising the hot gas temperature and reduction of the cooling air consumption (active cooling and leakage). Consequently, the loading of stator blades and rotor blades is inevitably increased. This can be counteracted, inter alia, by material developments and coating developments. There is another possible way of reducing stresses by constructional measures. With the same service life, components with reduced stress can endure higher temperatures. In this way, the requirement for higher hot gas temperature and lower cooling air consumption can be partially taken into consideration.

For reducing stresses on the blades, it has already been proposed to construct stator blades from individual components (outer and inner platforms and blade aero foil) and to fit them in gas turbines (see for example U.S. Pat. No. 5,494,404 or U.S. Pat. No. 5,564,897 or EP-A2-1176 284). The individual components of the blade in this case can be connected either in a form-fitting manner or by brazing or welding. In the one case, additional sealing joints are created. In the other case, deformations are transmitted between the components. Stator blades, however, are exposed to different loads than rotor blades because the centrifugal forces which are created as a result of the rotation of the machine are not applied in the case of stator blades.

It is furthermore known, in the case of rotor blades, to fit separate platforms as intermediate pieces between adjacent blades in the rotor (see WO-A1-2007/012587 or DE-A1-199 40 556). As a result of the decoupling of deformations from platform and blade aerofoil, lower stresses are created.

It has also been proposed (US-A1-2006/0120869) to construct a rotor blade from a multiplicity of individual blade elements, wherein the blade aerofoil is assembled from a core and a shell which encloses the core, and the core is anchored in a fixed manner in a blade root, a (lower) platform being formed on the blade root at the same time. As a result of this, a blade aerofoil and platform can, it is true, be decoupled with regard to deformations. However, the complex construction of the blade and the multiplicity of additional sealing joints which are associated with it, which in this case can also lead to increased leakage, is disadvantageous. In this case it is especially also disadvantageous that the forces which act on the blade aerofoil are not introduced directly into the blade carrier but via the blade root which is provided with the platform.

A method for producing a rotor blade is known from U.S. Pat. No. 6,331,217B1, in which individual blade segments are cast from a superalloy and then interconnected in a materially bonding manner by "Transient Liquid Phase (TLP) Bonding". In this case, it is true that sealing joints are dispensed with. The decoupling between the segments, however, is low or even nonexistent and the method is very costly.

EP 0 764 765 discloses a blade having an airfoil and a platform element made in two separate pieces. During operation, the centrifugal forces press the sides of the platform element against the airfoil element to get a strong coupling.

U.S. Pat. No. 5,378,110 discloses a compressor rotor having the platforms integrated into the rotor and strongly connected to airfoils.

EP 1 306 523 discloses airfoils connected to a rotor through Ω elements that prevent their pivoting. During operation, centrifugal forces press the sides of the Ω elements against the sides of the airfoils realizing a strong coupling.

DE 437 049 discloses turbine blades with T-shaped foot and spacers (defining the platform elements) to connect the blade to a blade carrier. Through this type of connection a strong coupling between blades and spacers is obtained.

SUMMARY

One of numerous aspects of the present invention relates to a rotor blade arrangement, especially for a gas turbine, which can avoid the disadvantages of known rotor blades and, with simultaneously simpler producibility, includes high decoupling of the platform deformations and blade aerofoil deformations.

Another aspect relates to a rotor blade arrangement which comprises a blade aerofoil element and a platform element, wherein the platform elements of a blade row form a continuous inner shroud, and the blade aerofoil element and platform element are formed as separate elements and can be fastened in each case separately on the blade carrier. As a result, a decoupling of the elements is achieved which has a prolonging effect upon the service life.

When adhering to principles of the present invention, a rotor blade arrangement is created which, on account of the decoupling of the platform deformations and blade aerofoil deformations, can have the following advantages:

Constrained stresses and geometric notches in the platform-blade aerofoil transition are avoided, and the stress level is decisively lowered as a result. This creates a service life advantage.

The use of separate blade elements enables an optimum material selection for the elements. This leads to a cost advantage.

By the use of fewer, relatively simpler individual elements, the manufacturing yield during production, for example during casting, is increased. This also leads to a cost advantage.

A possible coating of the individual elements with an anti-oxidation coating and a thermal barrier coating (TBC) is made significantly easier as a result of the absence of cross-sectional transitions (platform-blade aerofoil radius). This leads to a cost and quality advantage.

The reconditioning of the individual elements is simpler. The individual elements (platform element, blade aerofoil element) can be designed for different service lives. "Noble Parts" are reused and reconditioned, whereas cheap elements can be designed as disposable elements. This again leads to cost advantages.

One configuration of the rotor blade arrangement embodying principles of the present invention includes the blade aerofoil element comprising an aerodynamically effective blade aerofoil, a shank which adjoins the blade aerofoil at the bottom and is shrouded by the platform element, and a blade root which adjoins the shank at the bottom, wherein the blade root is provided for fastening the blade aerofoil element on the blade carrier, and the blade aerofoil element is formed in one piece. In particular the platform element is formed in one piece.

According to another configuration, the platform element has a through-opening through which the blade aerofoil element extends with the blade aerofoil.

An axial slot is preferably provided in each case for fastening the blade aerofoil element on the blade carrier, wherein the platform element has a device for separate fastening of the platform element on the blade carrier, and the fastening device engages in the axial slot for fastening of the platform element.

The blade aerofoil element especially has a blade root with a firtree profile, wherein the blade carrier has a correspondingly formed axial slot for accommodating the blade root, and the platform element, with legs as fastening devices, can be hooked into the slot of the blade carrier above the blade root. Other blade root profiles such as a dovetail profile or a T-profile are also conceivable.

According to a further configuration, a common platform element is provided for a plurality of blade aerofoil elements which are arranged next to each other, and extends across the plurality of blade aerofoil elements.

It is also conceivable that the platform element is arranged in each case between two adjacent blade aerofoil elements. For fastening of the blade aerofoil element, in this case an axial slot is provided in each case on the blade carrier, while the platform element has devices for separate fastening of the platform element on the blade carrier, which for fastening of the platform element engage in circumferential slots on the blade carrier.

Each of these platform elements preferably has a concavity for adapting to the suction side of the blade aerofoil element, and has a convexity for adapting to the pressure side of the blade aerofoil element.

Another configuration of the rotor blade arrangement includes seals for sealing the gaps between blade aerofoil element and platform element being arranged between blade aerofoil element and platform element.

According to another configuration, the blade aerofoil element is formed of materials which are different in different areas.

According to one exemplary embodiment, the blade aerofoil element has a leading edge and a trailing edge, and in the region of the leading edge and trailing edge is formed of a material which is different from that in the remaining region of the blade aerofoil element. Also, the blade tip may be formed of a different material.

According to another exemplary embodiment, the blade aerofoil element has a leading edge and/or trailing edge, and in the region of the leading edge or trailing edge is provided with an insert which is formed of a material which is different from that of the remaining region of the blade aerofoil element.

Another embodiment includes a blade aerofoil element having a suction side and/or pressure side, and in the region of the suction side or pressure side has an insert which is formed of a material which is different from that of the remaining region of the blade aerofoil element.

In this case, the regions which are formed of a different material extend downwards into the region of the blade aerofoil element which is shrouded by the platform element.

The seals which are provided between blade aerofoil element and platform element are advantageously designed so that they do not transmit any forces between blade aerofoil element and platform element. In this case, materially bonding connections, which transmit only small forces, or no forces, for example superplastic material, also come into consideration.

Another embodiment of a rotor blade arrangement includes an axial extension, which acts as a heat accumulation segment, arranged on the platform elements.

BRIEF DESCRIPTION OF THE DRAWINGS

The invention is to be subsequently explained in more detail based on exemplary embodiments in conjunction with the drawings. In the drawings.

DETAILED DESCRIPTION OF EXEMPLARY EMBODIMENTS

In general terms, one goal, in the case of a rotor blade of a gas turbine, is to avoid or to reduce the constrained stress as a consequence of varied deformation, which is induced as a result of varied temperature load and geometric notch effects. This can be achieved by separating the blade into a platform element and a blade aerofoil element as individual elements or individual components. The sealing gap which ensues as a result of the form-fitting connection between the individual elements in this case should be sealed so that force transmission no longer takes place between the individual elements in the machine during operation. The platform element in one exemplary embodiment in this case is pushed over the blade aerofoil element. In another exemplary embodiment, the platform element is arranged in each case between two adjacent blade aerofoil elements. The blade aerofoil element and the platform element are fastened separately on the rotor (blade carrier) so that the forces which act upon them are introduced into the blade carrier independently of each other.

For sealing without force transmission between a blade aerofoil element and a platform element, different types of seals are available:

(1) A "rope seal", as is described for example in U.S. Pat. No. 7,347,425B2. In this case, there are leakage losses, however.

(2) A "brush seal". Also in this case, leakage losses have to be taken into consideration.

(3) A temperature-resistant filling material for ensuring a 100%-sealing without leakage losses with simultaneous avoidance of force transmission, for example, by a superplastic material.

(4) Other seals are also conceivable, which are suitable for this application purpose.

The seal type (3) is preferred. The number or length of the sealing gaps between two platforms can be reduced by a plurality of blades sharing a common platform, or by a platform element extending across a plurality of blade aerofoil elements which are arranged next to each other.

The blade airfoil element 10 and the platform element 14 are assembled together and are then mounted on the blade carrier 19. The seals transmit substantially no forces; in this respect the seals may transmit small or marginal forces, but these forces do not prevent the airfoil and platform from being decoupled.

Figure 1:
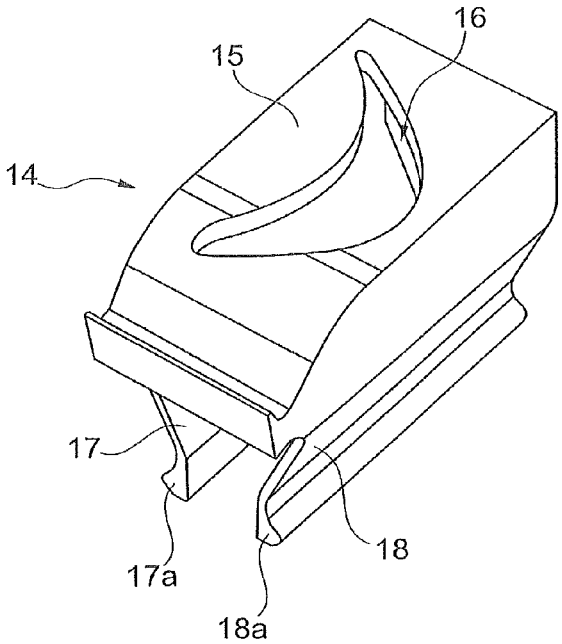
FIG. 1 shows, in a perspective view, a platform element for a rotor blade arrangement according to a first exemplary embodiment of the invention.
Figure 2:
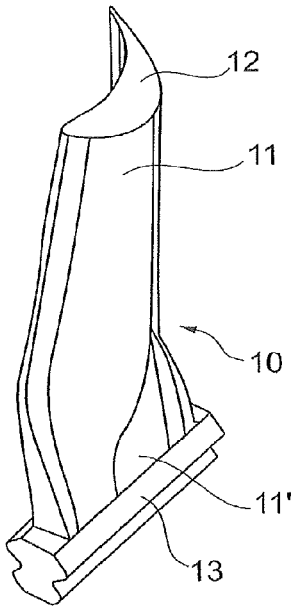
FIG. 2 shows, in a perspective view, the blade aerofoil element which is associated with the platform element of FIG. 1.
Figure 3C:
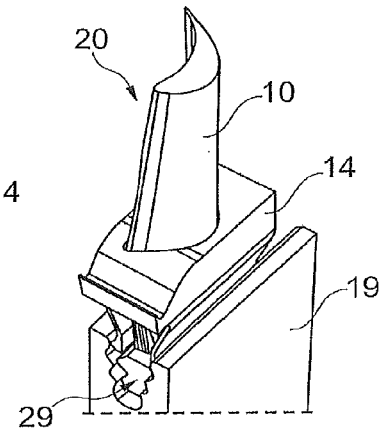
Figure 4:
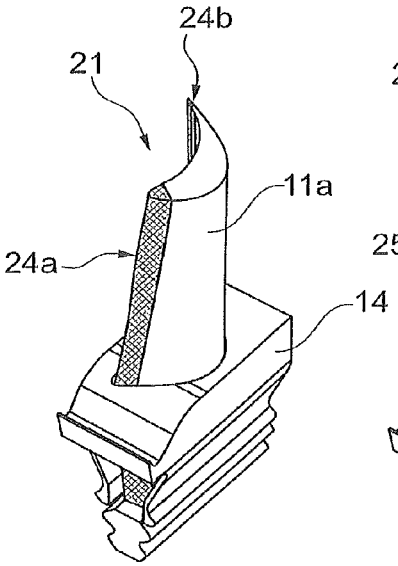
FIG. 4 shows a rotor blade arrangement which is comparable to FIG. 3*b*, in which a leading edge and a trailing edge is formed of a different blade aerofoil material.
Figure 5:
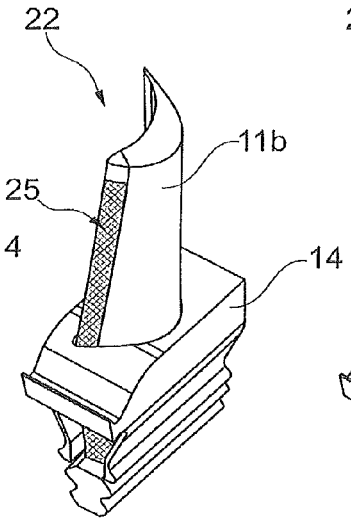
FIG. 5 shows a rotor blade arrangement which is comparable to FIG. 3*b*, in which an insert, which is formed of a different blade aerofoil material, is provided in the leading edge.
Figure 6:
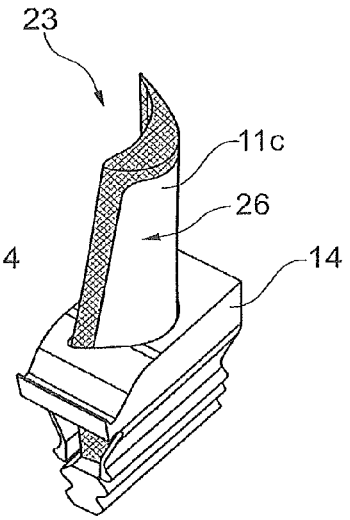
FIG. 6 shows a rotor blade arrangement which is comparable to FIG. 3*b*, in which an insert, which is formed of a different blade aerofoil material, is provided in the suction side.

In FIGS. 1 and 2, a platform element 14 and a blade aerofoil element 10 for an assembled rotor blade arrangement, according to a first exemplary embodiment of the invention, are shown in a perspective view. The blade aerofoil element 10 (FIG. 2) includes a blade aerofoil 11, which extends in the blade longitudinal direction (radial direction of the rotor), with the customary aerofoil section with a leading edge and a trailing edge, and also a suction surface and a pressure surface. The blade aerofoil 11 terminates at the upper end in a blade tip 12. At the bottom end, the blade aerofoil 11 merges first into a shank 11' and then into a blade root 13 which, in this example, has a firtree-like cross-sectional profile (other types of fastening are also conceivable). The blade root 13 can be inserted into a correspondingly profiled slot (29 in FIG. 3*c*) in a blade carrier (19 in FIG. 3*c*) which is associated with the rotor, and retained there. The blade aerofoil element 10, with regard to the sections 11, 11' and 13, is formed in one piece, although specific regions may be formed of a different material which is connected to the blade aerofoil element 10 in a materially bonding manner (FIGS. 4-6). The customary cooling passages, which for example are supplied with cooling air through the blade root 13 or through side accesses in the region of the shank 11' (beneath the platform element 14), can be arranged inside the blade aerofoil element 10.

Figure 3A:
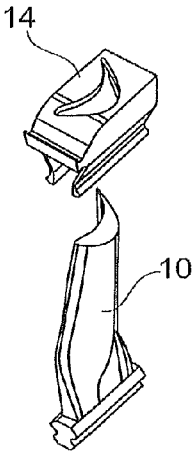
FIGS. 3*a*-3*c* show the assembly (FIG. 3*b*) and installation (FIG. 3*c*) of the rotor blade arrangement which, according to FIG. 3*a*, is assembled from the elements from FIGS. 1 and 2.
Figure 3B:
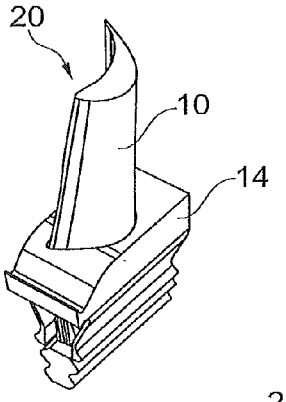
Figure 13:
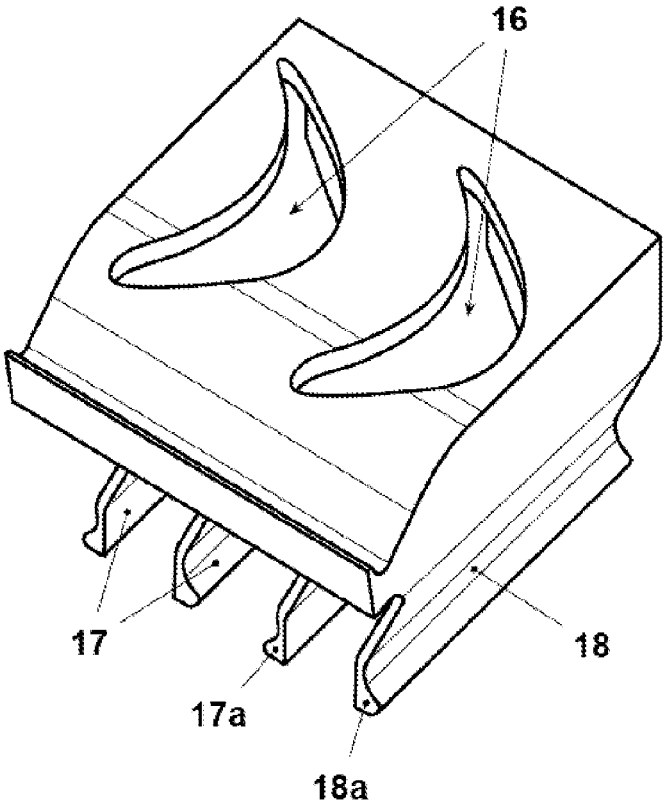
FIG. 13 shows, in a perspective view, a platform element for a rotor blade arrangement according to a second exemplary embodiment of the invention.
Figure 14:
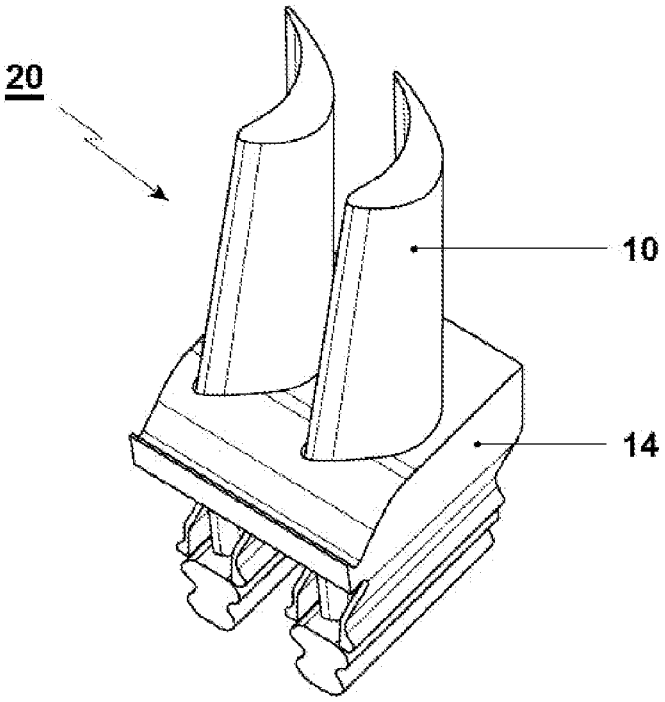
FIG. 14 shows the assembly of the rotor blade arrangement of FIG. 13.

For completion of the rotor blade arrangement (20 in FIGS. 3*b* and 3*c*), the platform element 14 of FIG. 1 is provided. The one-piece platform element 14 has an upper side 15 with which, in the installed state, it inwardly delimits the hot gas passage of the turbine. All the platform elements 14 of a blade row which are arranged on the circumference of the rotor together create a closed inner shroud. In the upper side 15, a through-opening 16, which is adapted to the cross-sectional profile of the blade aerofoil 11, is provided, through which the blade aerofoil 11 can be fitted from the bottom so that platform element 14 and blade aerofoil 11 tightly adjoin each other, forming a sealing gap (FIGS. 3*b*, 3*c*). Towards the bottom, the platform element 14 has two downwardly extending legs 17, 18 which extend parallel to each other and parallel to the longitudinal direction of the blade root 13, with which the platform element 14 can be fastened on the blade carrier 19 independently of the blade root 13. For this purpose, the platform element 14, which in the form-fitting manner is pushed over the blade aerofoil 11, can be hooked into the axial slot 29 of the blade carrier 19 above the blade root 13 by hooks 17*a*, 18*a* which are formed on the end of the legs 17, 18 of the platform element (FIG. 3*c*). FIGS. 13 and 14 illustrate an embodiment in which multiple, e.g., first and second, blade aerofoil elements are provided adjacent to each other, and the platform element 14 is arranged between the two adjacent blade aerofoil elements. The blade carrier has an axial slot for receiving and fastening the blade aerofoil elements, and circumferential slots, and the platform element has a separate fastener which fastens the platform element on the blade carrier, engages in the circumferential slots.

In this way, with only two individual elements or individual components, which are constructed and to be produced in a comparatively simple manner, an assembled rotor blade arrangement 20 can be constructed, in which, on the one hand, the blade aerofoil and platform can be mechanically decoupled and, on the other hand, the ensuing sealing gaps can be sealed with limited cost. If a platform element is commonly provided for a plurality of blade aerofoil elements which are arranged next to each other, it is formed wider in the circumferential direction and correspondingly has a plurality of through-openings 16 instead of the one.

Figure 7:
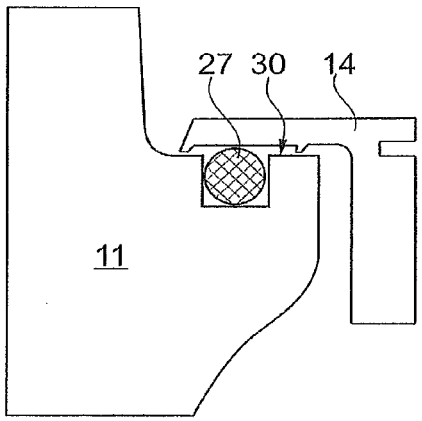
FIG. 7 shows the cross section through a blade aerofoil-platform sealed transition in a rotor blade arrangement according to an exemplary embodiment of the invention.
Figure 8:
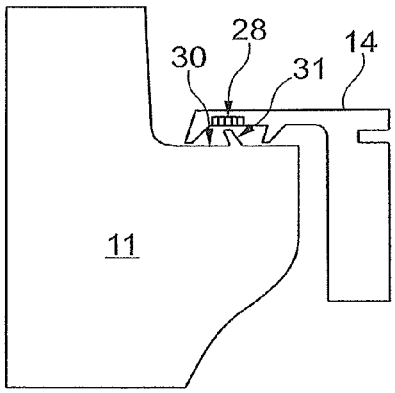
FIG. 8 shows the cross section through a blade aerofoil-platform transition which is sealed in a second way in a rotor blade arrangement according to an exemplary embodiment of the invention.
Figure 12:
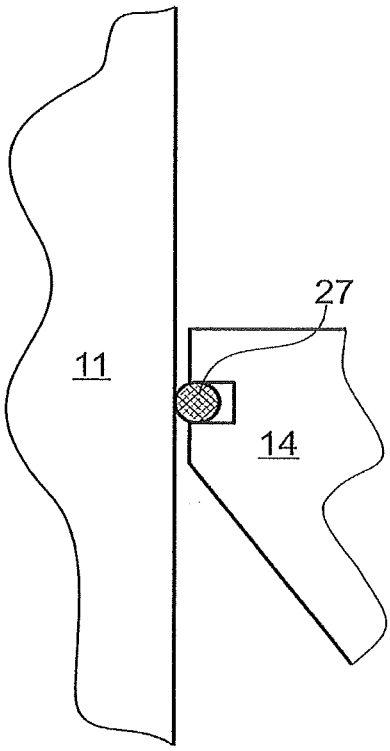
FIG. 12 shows a cross section through a blade aerofoil-platform sealed transition in the region of the suction side and/or pressure side in a rotor blade arrangement according to an exemplary embodiment of the invention.

Different variants of the sealing are shown in FIGS. 7, 8, and 12. In the case of the sealing variants of FIGS. 7 and 8, a horizontal shoulder 30, over which the platform element 14 fits, is formed on the blade aerofoil 11. Between the shoulder 30 and platform element 14, a sealing system is arranged in each case, which in the case of FIG. 7 includes a rope seal 27, or something else, which is accommodated in a slot, while in the case of FIG. 8 it has a sealing lip 31 which is formed on the shoulder 30 and interacts with a honeycomb 28 (or even a brush seal) which lies opposite in the platform element 14. It is also conceivable, according to FIG. 12, to arrange a rope seal 27, or something else, in the platform element 14 and to allow this seal to abut horizontally against a surface of the blade aerofoil 11.

Furthermore, it can be advantageous to construct the blade aerofoil element 10 according to FIGS. 4-6 in different sections of different materials, especially also in the region of the blade aerofoil 11. In the example of FIG. 4, the leading edge 24*a* and the trailing edge 24*b* of the rotor blade arrangement 21 are formed totally of a material which is different from that of the remaining blade aerofoil 11*a*. In the example of FIG. 5, an insert 25 is embedded into the leading edge of the rotor blade arrangement 22 and is formed of a material which is different from that of the remaining blade aerofoil 11*b*. In the example of FIG. 6, finally an insert 26 is embedded into the suction side of the rotor blade arrangement 23 and is formed of a material which is different from that of the remaining blade aerofoil 11*c*. As a result, particularly loaded regions of the blade aerofoil can be differently designed with regard to material than the remaining regions. In this case, it is advantageous if the regions (24*a*, 24*b*, 25, 26) which are formed of a different material, extend downwards into the region of the blade aerofoil element 10 which is shrouded by the platform element 14, because the discontinuity which is associated with the transition between the regions of different material is then not exposed to the extreme temperature conditions which prevail in the region of the blade aerofoil.

Figure 9:
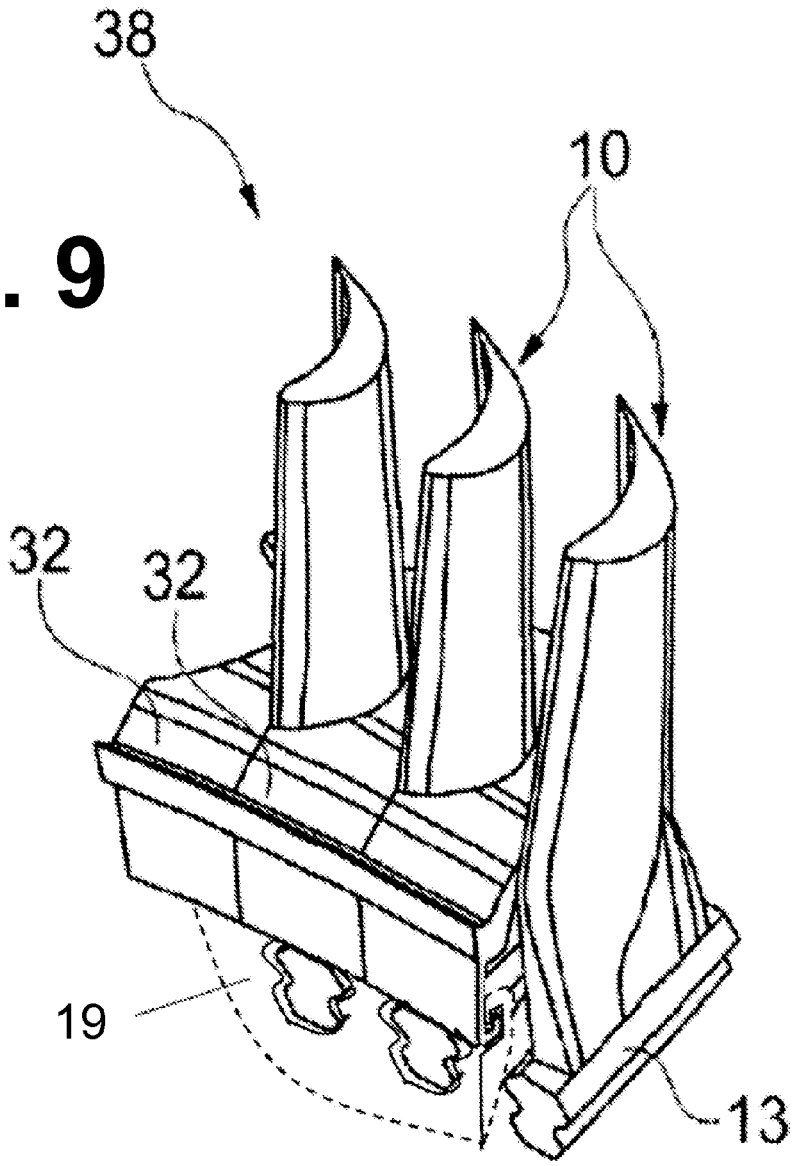
FIG. 9 shows, in a view which is comparable to FIG. 3*b*, a rotor blade arrangement according to another exemplary embodiment of the invention, in which separate platform elements are arranged between adjacent blade aerofoil elements and are retained in separate circumferential slots.
Figure 10:
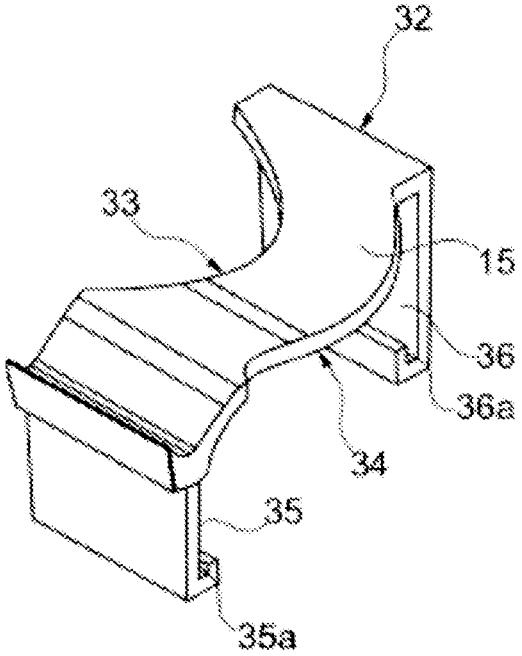
FIG. 10 shows, in a perspective view, an individual platform element according to FIG. 9.

Another exemplary embodiment of the invention is reproduced in FIGS. 9 and 10. In this case, the platform elements 32 are arranged in the rotor blade arrangement 38 between two adjacent blade aerofoil elements 10 in each case. The individual platform elements 32 on their upper side 15 have corresponding concavities 33 or convexities 34, with which they adapt to the suction sides or pressure sides of the adjacent blade aerofoil elements 10. Also in this case, all the platform elements 32 of a blade row together form a closed inner shroud which extends over the circumference. The fastening of the platform elements 32 is carried out in this example differently from in FIG. 3*c*, while it is true that the platform element 32 again has downwardly projecting parallel legs 35, 36 with hooks 35*a*, 36*a* which are formed on the ends. These legs 35, 36 and hooks 35*a*, 36*a*, however, lie transversely to the longitudinal direction of the blade root 13 and therefore engage in separate circumferential slots on the rotor.

Figure 11:
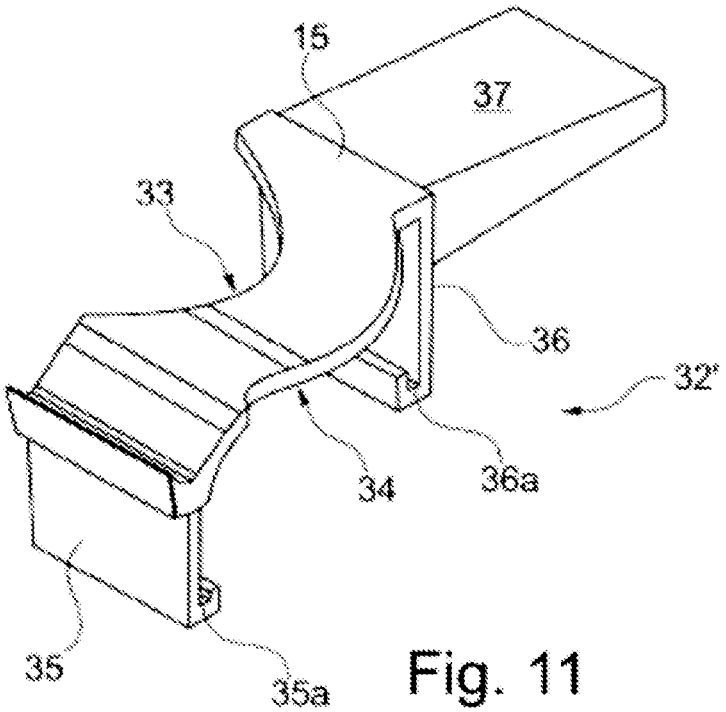
FIG. 11 shows, in a view which is comparable to FIG. 10, a platform element with an axial extension which forms a heat accumulation segment.

According to FIG. 11, platform elements 32' can also be provided, upon which an axial extension 37, which preferably acts as a heat accumulation segment, is arranged, which in FIG. 11 is indicated only in outline. Such extensions 37 can then cover further regions of the rotor and can act as barriers against the thermal load of the rotor without separate elements having to be installed, as is the case, for example, in WO-A1-2005/054634.

REFERENCES

10 Blade aerofoil element
11 Blade aerofoil
11*a*, 11*b*, 11*c* Blade aerofoil
11' Shank
12 Blade tip
13 Blade root
14, 32, 32' Platform element
15 Upper side (platform element)
16 Through-opening
17, 18 Leg
17*a*, 18*a* Hook
19 Blade carrier
20,21,22,23,38 Rotor blade arrangement
24*a* Leading edge
24*b* Trailing edge
25 Insert (leading edge)
26 Insert (suction side)
27 Rope seal
28 Honeycomb
29 Slot
30 Shoulder
31 Sealing lip
33 Concavity
34 Convexity
35, 36 Leg
35*a*, 36*a* Hook
37 Axial extension (heat accumulation segment)

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A rotor blade arrangement comprising:

a first blade aerofoil element;

a platform element, wherein the platform element is configured and arranged to form a part of a blade row continuous inner shroud;

wherein the first blade aerofoil element and the platform element are separate elements and are each configured and arranged to be separately fastened on a rotor;

wherein the first blade aerofoil element and the platform element are configured and arranged to be mechanically decoupled during operation of the rotor blade arrangement;

a second blade aerofoil element adjacent to the first blade aerofoil element;

wherein the platform element is arranged between the first and second adjacent blade aerofoil elements;

the rotor having an axial slot for receiving and fastening the first blade aerofoil element and separate circumferential slots configured to receive and fasten the platform element to the rotor;

wherein the platform element comprises downwardly projecting vertically extending legs that extend transversely to a longitudinal direction of a blade root, each leg having a hook formed on an end of the leg that extends upward vertically to engage in a respective one of the circumferential slots of the rotor to fasten the platform element to the rotor without any intervening parts; and wherein the first blade aerofoil element is formed in one piece and the platform element is formed in one piece.

2. The rotor blade arrangement as claimed in claim 1, wherein the platform element includes a concavity through which the first blade aerofoil element extends.

3. The rotor blade arrangement as claimed in claim 1, further comprising:

a common platform element comprising said platform element, the common platform element being configured and arranged to extend across the first and second blade aerofoil elements.

4. The rotor blade arrangement as claimed in claim 1, further comprising:

a heat accumulation axial extension on the platform element.

5. The rotor blade arrangement as claimed in claim 1, comprising:

a shoulder over which the platform element fits that is formed on the first blade aerofoil element.

6. The rotor blade arrangement as claimed in claim 1, wherein the first blade aerofoil element has regions of a-different material that extend downwardly into a region of the first blade aerofoil element which is shrouded by the platform element.

7. The rotor blade arrangement as claimed in claim 1, wherein the first blade aerofoil element comprises a suction side and a pressure side, and a top of the platform element comprises a concavity for adapting the platform element to the first blade aerofoil element suction side and a convexity for adapting to the first blade aerofoil element pressure side.

8. The rotor blade arrangement as claimed in claim 1, wherein the first blade aerofoil element is formed of materials which are different in different areas of the blade aerofoil element.

9. The rotor blade arrangement as claimed in claim 8, wherein the first blade aerofoil element comprises a leading edge and a trailing edge, and the first blade aerofoil element in the regions of the leading edge and of the trailing edge is formed of a material which is different from that in remaining regions of the first blade aerofoil element.

10. The rotor blade arrangement as claimed in claim 8, wherein the first blade aerofoil element comprises a leading edge, a trailing edge, or both, and an insert in the region of the leading edge or of the trailing edge, the insert formed of a material which is different from that of remaining regions of the first blade aerofoil element.

11. The rotor blade arrangement as claimed in claim 8, wherein the first blade aerofoil element comprises a suction side, a pressure side, or both, and an insert in the region of the suction side or of the pressure side, the insert formed of a material which is different from that of remaining regions of the first blade aerofoil element.

12. The rotor blade arrangement as claimed in claim 8, wherein the regions of a different material extend downwardly into a region of the first blade aerofoil element which is shrouded by the platform element.

13. The rotor blade arrangement as claimed in claim 1, comprising:

one or more seals defined between the first blade aerofoil element and the platform element, each of the seals configured and arranged to seal at least one gap between the first blade aerofoil element and the platform element, each seal being configured so that substantially no forces are transmitted between the first blade aerofoil element and the platform element via that seal.

* * * * *